US009947491B1

(12) United States Patent
Thome et al.

(10) Patent No.: US 9,947,491 B1
(45) Date of Patent: Apr. 17, 2018

(54) MAGNETIC SENSOR ALIGNMENT WITH BREAKAWAY

(71) Applicant: Microsoft Technology Licensing, LLC, Redmond, WA (US)

(72) Inventors: Nathan Michael Thome, Renton, WA (US); Kenneth Charles Boman, Duvall, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 15/297,068

(22) Filed: Oct. 18, 2016

(51) Int. Cl.
*H01H 13/14* (2006.01)
*H01H 36/00* (2006.01)
*H01H 5/02* (2006.01)

(52) U.S. Cl.
CPC ..... *H01H 13/14* (2013.01); *H01H 36/0073* (2013.01); *H01H 5/02* (2013.01); *H01H 36/00* (2013.01); *H01H 36/0006* (2013.01)

(58) Field of Classification Search
CPC ..... H01H 36/00; H01H 36/0073; H01H 36/0006; H01H 5/02; H01H 2003/506; H01H 2001/545; H01H 36/002; H01H 36/008; H01H 9/443; H01H 2215/042; H01H 2227/032
USPC ... 200/5 A, 314, 340–345, 82 E, 334, 19.36; 335/205–207
See application file for complete search history.

(56) References Cited

U.S. PATENT DOCUMENTS 5,040,640 A 8/1991 Slabinski et al.
5,262,752 A 11/1993 Truong et al.
5,921,382 A 7/1999 Retter
6,199,587 B1 3/2001 Shlomi et al.
6,528,748 B2 3/2003 Harris et al.
6,677,843 B1 * 1/2004 Monroe ..... H01H 13/705 200/512
7,026,898 B2 4/2006 Ableitner et al.
8,235,235 B1 8/2012 Lusch
8,963,666 B2 2/2015 Bilbrey et al.
(Continued)

FOREIGN PATENT DOCUMENTS

CN 202601440 U 12/2012

OTHER PUBLICATIONS

"How Reed Switches are used with a Permanent Magnet", Published on: Oct. 27, 2011 Available at: https://www.digikey.com/Web%20Export/Supplier%20Content/Meder_374/PDF/MEDER_Reedswitch_used_with_permanent_magnet.pdf.

*Primary Examiner* — Ahmed Saeed
(74) *Attorney, Agent, or Firm* — Lempia Summerfield Katz LLC

(57) ABSTRACT

Disclosed herein are electronic devices with a sensor configured to breakaway from an input button or input/output interface. In one example, the electronic device includes a button positioned within an opening of a chassis or housing. A sensor is in communication with the button, wherein the button is configured to contact the sensor in a first sensor position upon application of an activation force. At least one magnet is configured to retain the sensor in the first sensor position by a frictional or magnetic force. Additionally, the sensor is configured to move from the first sensor position to a second sensor position upon application of a force greater than the frictional or magnetic force and less than a sensor damage force. The activation force is less than the frictional or magnetic force, which is less than the sensor damage force.

18 Claims, 8 Drawing Sheets

(56) References Cited

U.S. PATENT DOCUMENTS

| | | | | |
|---|---|---|---|---|
| 8,970,331 | B2 * | 3/2015 | Chang | H01H 13/702 200/341 |
| 9,324,515 | B2 | 4/2016 | Krumpelman et al. | |
| 9,646,781 | B1 * | 5/2017 | Gluchman, Jr. | H01H 13/14 |
| 2003/0183659 | A1 | 10/2003 | Van Zeeland et al. | |
| 2010/0025216 | A1 * | 2/2010 | Huang | H01H 5/02 200/522 |
| 2013/0321971 | A1 | 12/2013 | Khayzikov et al. | |
| 2014/0034468 | A1 * | 2/2014 | Krumpelman | H01H 3/122 200/5 A |
| 2014/0097709 | A1 | 4/2014 | Ueno et al. | |
| 2015/0243456 | A1 * | 8/2015 | Hsu | H01H 13/20 200/344 |
| 2016/0057265 | A1 | 2/2016 | Gibbons | |

* cited by examiner

MAGNETIC SENSOR ALIGNMENT WITH BREAKAWAY

BACKGROUND

Current design trends for electronic such as tablet computers, display devices, or mobile phones include designs having an increase in power, a decrease in size (e.g., height, length, and/or width), and an increase in speed. As the size of the electronic device is reduced, certain internal device components may be positioned closer together. This provides for challenges in manufacturing design.

SUMMARY

Electronic devices having an external button or an input/output interface and connectable internal sensor are described herein. In one or more embodiments, the electronic device includes a chassis having an internal volume configured to house internal components of the electronic device; a button positioned within an opening of the chassis, wherein the button is configured to move from a first button position to a second button position, wherein, in the first button position, a surface of the button extends beyond an external surface of the chassis, and wherein, in the second position, the surface of the button is located at a closer distance to the external surface of the chassis than in the first button position; a rigid support positioned within the internal volume of the chassis; a sensor connected with the rigid support and in communication with the button, wherein the button is configured to contact the sensor at an intermediate button position located between the first button position and the second button position; at least one magnet positioned within the internal volume of the chassis, wherein the at least one magnet is configured to retain the sensor in a first sensor position when the button moves between the first button position and the intermediate button position, and wherein the at least one magnet is configured to release the sensor from the first sensor position such that the sensor moves from the first sensor position to a second sensor position before the button moves from the intermediate button position to the second button position.

In another embodiment, an electronic device includes a housing; a button extending through an opening of the housing; a sensor in communication with the button, wherein the button is configured to contact the sensor in a first sensor position upon application of an activation force as measured in a direction from the button to the sensor and along a plane including the button and the sensor; and at least one magnet configured to retain the sensor in the first sensor position by a frictional or magnetic force as measured in a same plane or parallel plane as the activation force, wherein the sensor is configured to move from the first sensor position to a second sensor position upon application of a force greater than the frictional or magnetic force and less than a sensor damage force, as measured in the same plane or parallel plane as the activation force, and wherein the activation force is less than the frictional or magnetic force, and the frictional or magnetic force is less than the sensor damage force.

In another embodiment, an electronic device includes a housing; an input/output interface positioned within an opening of the housing; a sensor in communication with the input/output interface; and at least one magnet configured to retain the input/output interface and the sensor in the first position by a frictional or magnetic force, wherein the input/output interface and the sensor are configured to move away from the opening of the housing from the first position to a second position upon application of a force to the input/output interface that is greater than the frictional or magnetic force and less than a sensor damage force.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DESCRIPTION OF THE DRAWING FIGURES

For a more complete understanding of the disclosure, reference is made to the following detailed description and accompanying drawing figures, in which like reference numerals may be used to identify like elements in the figures.

Figure 1:
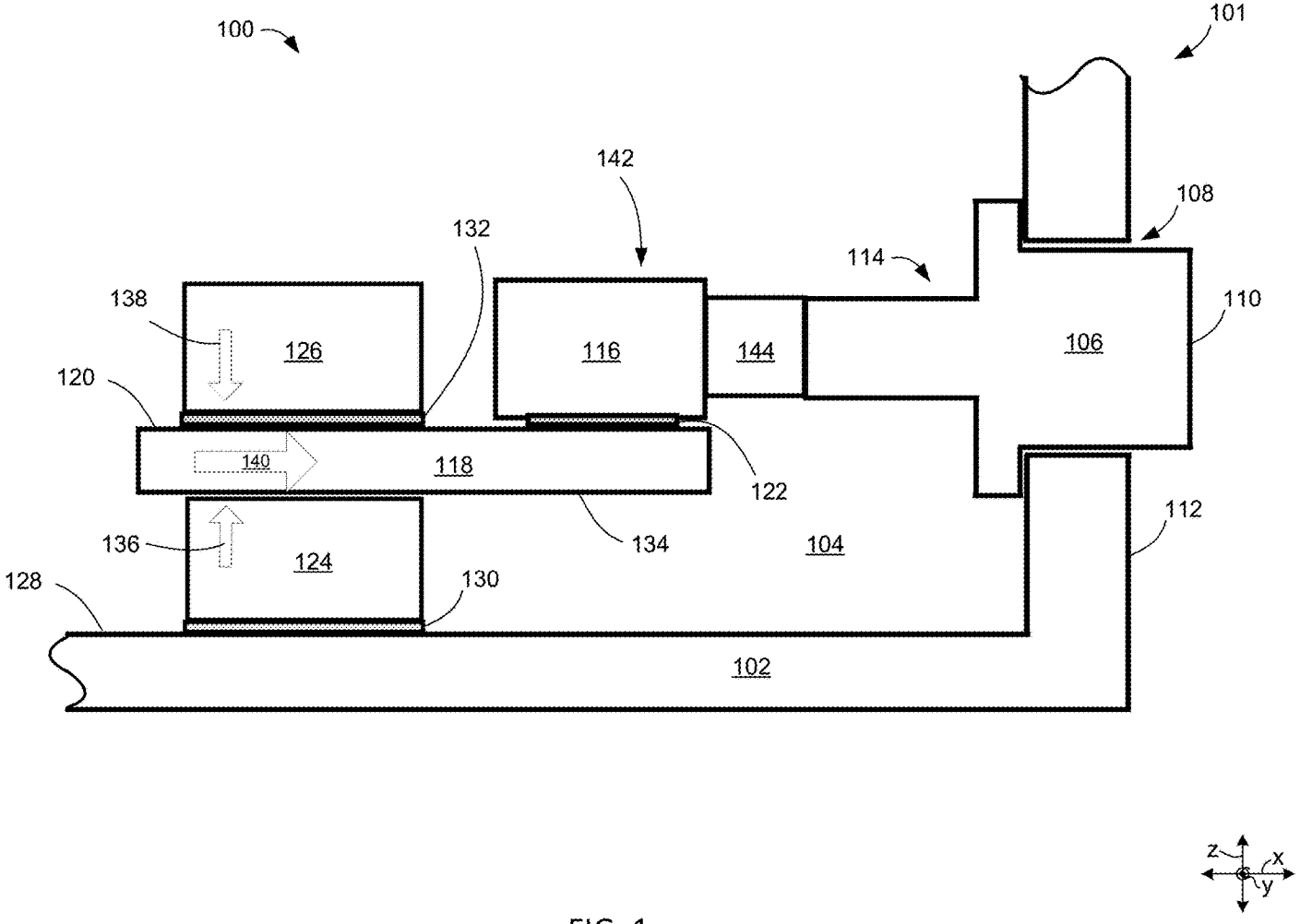
FIG. 1 depicts an example of an electronic device having a button in a first button position and a sensor in a first sensor position.

While the disclosed systems and methods are susceptible of embodiments in various forms, specific embodiments are illustrated in the drawing (and are hereafter described), with the understanding that the disclosure is intended to be illustrative, and is not intended to limit the claim scope to the specific embodiments described and illustrated herein.

DETAILED DESCRIPTION

Electronic devices having an external button or an input/output (I/O) interface and connectable internal sensor are described herein. During operation of the electronic device, the button may be pressed by a user (or a device may be plugged into the input/output interface), wherein the sensor is activated.

Such a button and sensor combination may be useful for activating a (e.g., programmable) function of the electronic device. Non-limiting examples of such functions include powering the electronic device on or off, turning a display screen on or off, changing the output volume from a speaker of the device, changing a display on a display screen, capturing a digital image, or starting or stopping a recording of a video.

In certain electronic devices, the internal sensor may be damaged when the external button is pressed inward into the electronic device (or a device is plugged into the I/O interface) with excessive force. For example, the electronic device may be accidentally dropped, and the device may land on the ground on the surface of the external button or a device plugged into the I/O interface. Due to the design of the electronic device and impact of an external button connected with sensor, the sensor may be damaged and fail to function under such a drop scenario. For example, a user may no longer be able to power on or off the device. Additionally, such damage to the device may result in a warranty return, or the user's perception of poor product quality. This provides challenges in the manufacturing design of an electronic device to avoid damage to the internal sensor (e.g., a mechanical switch).

As disclosed herein, the sensor of the electronic device is configured to move or breakaway from its primary location to avoid damage to the sensor. This may be accomplished by positioning one or more magnets within the chassis or housing of the electronic device. A magnet may be connected to the sensor or to a rigid support connected to the sensor such that the magnet secures the sensor in place by a retention force. In other words, the sensor may be configured to move or breakaway from a first sensor position to a second sensor position when an input force placed on the external button or I/O interface exceeds the retention force provided by the at least one magnet.

This is advantageous in protecting the sensor and any connected components from being damaged by the input force on the external button or I/O interface. For example, during normal operation of the electronic device, an input force on the button by the user will activate the sensor. The sensor remains in a first sensor position. When a larger, excessive input force on the button is provided (e.g., when the electronic device is accidentally dropped), the sensor overcomes the retention force of the magnets and move inward to a second sensor position. This movement protects the sensor and any connected components from being damaged when large forces are applied on the external button.

Such electronic devices have several potential end-uses or applications, including any electronic device having an external input button or I/O interface. In particular, such electronic devices may be included within a mobile electronic device, including, but not limited to, personal computers (PCs), tablet and other handheld computing devices, laptop or mobile computers, communications devices such as mobile phones, multiprocessor systems, microprocessor-based systems, programmable consumer electronics, mini-computers, audio or video media players, or video game controllers. In certain examples, the computing environment is a wearable electronic device, wherein the device may be worn on or attached to a person's body or clothing.

Various examples of such electronic devices are discussed in further detail below.

FIG. 1 depicts a first configuration 100 of an electronic device 101 including a housing or chassis 102 having an internal volume 104 configured to house internal components of the electronic device 101. The housing or chassis 102 may be manufactured of any suitable composition, such as one or more plastics, metals, acrylics, carbon fibers, or polymers.

An external button 106 is positioned within an opening 108 of the chassis 102. The external button 106 may be positioned at any location along a surface of the chassis 102. As depicted in FIG. 1, the button 106 protrudes from the opening 108 of the chassis 102. In other words, a surface 110 of the button 106 is positioned farther from the internal volume 104 of the chassis than an outer surface 112 of the chassis 102 (as viewed along the x-axis). The button 106 is located in a first button position 114.

In certain alternative examples, the surface 110 of the button 106 is flush with the external surface 112 of the chassis 102 in the first button position (e.g., such that no surface of the button extends outside from the external surface 112 of the chassis 102).

The button 106 may be manufactured from any material capable of creating a connection with the sensor 116. For example, the button 106 may be made from one or more plastics, metals, acrylics, carbon fibers, or polymers (e.g., elastomeric polymers). In certain examples, the button material may be an electrically conductive material. In certain examples, the button material is the same material as the chassis 102. In other examples, the button material is a different material from the chassis 102, which may allow for easier visual or sensory identification for the user of the location of the button 106.

In some examples, the button 106 may be identified by a different color from the chassis 102. This may provide easier visual identification for the user of the location of the button 106.

The button 106 is in communication with a sensor 116 positioned within the internal volume 104 of the electronic device 101. The button 106 is configured to be pressed by a user to activate the sensor 116 (e.g., mechanical switch). This is advantageous in activating a (e.g., programmable) function of the electronic device such as powering the electronic device on or off, turning a display screen on or off, changing the output volume from a speaker of the device, changing a display on a display screen, capturing a digital image, or starting or stopping a recording of a video.

When pressed, the button 106 is configured to move from the first button position 114 to an intermediate button position (discussed below with reference to FIG. 2), wherein the button 106 activates the sensor 116 and a function of the electronic device 101.

As depicted in FIG. 1, the sensor 116 is a mechanical switch. In alternative examples, the sensor may be a capacitive sensor array, resistive touch sensor, a plurality of pressure sensitive sensors (e.g., membrane switches using a pressure sensitive ink), an optical sensor, a piezoelectric sensor (e.g., a piezoelectric film), another input sensing mechanism, or any combination thereof.

The sensor 116 may be connected directly or indirectly to a rigid support 118. This is advantageous in securing the sensor 116 to a rigid structure configured to assist in control of movement of the sensor 116 within the internal volume of the chassis 102.

The rigid support 118 may include a circuit (e.g., a printed circuit board). As depicted in FIG. 1, the printed circuit board is connected with the sensor 116 to detect and process user input via the button 106. In alternative examples, the rigid support 118 is a support structure such as a metal frame (e.g., a steel bracket). The support structure may be connected to a flexible circuit, which itself may be connected with the sensor. In such an example, the sensor 116 is indirectly connected with the rigid support 118 via the flexible circuit.

As depicted in FIG. 1, the sensor 116 (e.g., mechanical switch) is adhered to a first surface 120 of the rigid support 118 (e.g., printed circuit board). The sensor 116 is soldered to the rigid support via a solder joint 122. Alternatively, the sensor 116 may be adhered to the first surface 120 of the rigid support 118 via an adhesive layer. The adhesive layer may include one or more pressure-sensitive adhesive materials. Additional or alternative types of adhesive materials and films may be used, including, for instance, moisture or thermally cured adhesive materials. The adhesive materials of the adhesive layers may be silicone-based, epoxy-based and/or acrylic-based materials.

At least one magnet is positioned within the internal volume 104 of the chassis 102, wherein the at least one magnet is configured to control movement of the sensor 116 and rigid support 118 within the chassis 102 between one or more sensor positions. As depicted in FIG. 1, the sensor 116 is positioned in a first sensor position 142.

The at least one magnet includes a first magnet 124 and a second magnet 126. The first magnet 124 is affixed to an internal surface 128 of the chassis 102. The first magnet 124 may be soldered to the chassis 102 via a solder joint 130. Alternatively, the first magnet 124 may be affixed to the chassis 102 via an adhesive layer such as a pressure-sensitive adhesive material, a moisture cured adhesive material, or a thermally cured adhesive material. The adhesive material of the adhesive layers may be silicone-based, epoxy-based, and/or acrylic-based materials.

A second magnet 126 is affixed to a surface 120 of the rigid support 118. The second magnet 126 may be soldered to the rigid support 118 via a solder joint 132. Alternatively, the second magnet 126 may be affixed to the rigid support 118 via an adhesive layer such as a pressure-sensitive adhesive material, a moisture cured adhesive material, or a thermally cured adhesive material. The adhesive material of the adhesive layers may be silicone-based, epoxy-based, and/or acrylic-based materials.

The first and second magnets 124, 126 may be any type of magnet. In some examples, either or both of the first and second magnets 124, 126 may be permanent magnets such as neodymium iron boron (NdFeB) magnets, samarium cobalt (SmCo) magnets, iron alloy magnets (e.g., aluminum-nickel-cobalt or "alnico" magnets), or ceramic or ferrite magnets. In some examples, the permanent magnet includes a metal such as copper, titanium, aluminum, iron, bismuth, manganese, neodymium, boron, nickel, cobalt, steel (e.g., electrical steel), or alloys thereof. In some examples, either or both of the first and second magnets 124, 126 are rare earth magnets such as alloys of rare earth elements (e.g., elements in the lanthanide series, plus scandium and yttrium). Such rare earth magnets may be advantageous due to their strong attraction forces, which may allow for a smaller sized magnet to be placed within the internal volume of the electronic device.

Either or both of the first and second magnets 124, 126 may be temporary magnets (e.g., soft iron devices) that behave like a permanent magnet when in the presence of a magnetic field. Alternatively, either or both of the first and second magnets 124, 126 may be electromagnets (e.g., solenoids) wherein an electrical current is passed through the composition to provide a magnetic field. In such examples, the electronic device 101 also includes one or more electronic components within the internal volume 104 configured to provide an electrical current to create the magnetic field for the temporary or electromagnet.

In certain examples, the first and second magnets 124, 126 are the same type of magnet made of a same composition. The first and second magnets 124, 126 may be dipole magnets that are positioned relative to each other such that the north pole of one magnet is adjacent to the south pole of the additional magnet (wherein the magnets are attracted to each other).

In other examples, the first and second magnets 124, 126 are made of different compositions. Nonetheless, the first and second magnets 124, 126 are configured such that the magnets are attracted to each other to provide a magnetic or frictional force to control movement of the sensor 116 and the rigid support 118.

The size and shape of the first and second magnets 124, 126 may be configurable as well based on the size of the electronic device and the desired magnetic or frictional force provided by the magnets 124, 126. For example, the magnetic or frictional force produced by the magnets should be greater than the application force on the button 106 such that the sensor 116 does not move when a user applies the application force. Additionally, the magnetic or frictional force produced by the magnets should be less than the amount of input force that can damage the sensor 116 (i.e., a sensor damage force), such that the sensor 116 is configured to move positions before being damaged by an excessive input force. In some examples, the shape of the magnet is a cube or [3D rectangle]. The thickness or height of the magnet (as viewed in the z-direction) may be 0.1-10 mm, 1-5 mm, or 1-3 mm. The length and/or width of the magnet (as viewed within the x,y-plane) may be 1-100 mm, 1-50 mm, 1-25 mm, 1-10 mm, 5-10 mm, 10-20 mm, or 20-30 mm.

The positioning of the first magnet 124 in relation to the second magnet 126 is also configurable. In one example, the first magnet 124 is positioned such that the center of the first magnet 124 is aligned with the center of the second magnet 126 along an axis perpendicular with the internal surface 128 of the chassis 102 (e.g., the z-axis in FIG. 1). In other examples, the center of the first magnet is not aligned with the second magnet along the axis when the sensor and rigid support are positioned in the first sensor position. In other examples, the positioning of the first magnet 124 relative to the second magnet 126 is based on an auto-alignment of the two magnets by the attraction forces of the two magnets.

As depicted in FIG. 1, the first magnet 124 and the second magnet 126 are positioned on opposite surfaces of the rigid support 118. The magnets are arranged such that the first magnet 124 is attracted to the second magnet 126. In other words, the polarity at a surface of the first magnet 124 adjacent to the rigid support 118 has the opposite polarity as a surface of the second magnet 126 adjacent to the rigid support 118. This magnetic attraction is configurable to control the movement of the sensor 116 and rigid support 118 within the chassis 102.

For instance, based on the magnetic attraction between the two magnets, the first magnet 124 is configured to abut a surface 134 of the rigid support 118 and provide a first magnetic force 136 upon the surface 134 of the rigid support 118. The second magnet 126 is attached to the opposite surface 120 of the rigid support 118, wherein the second magnet 126 provides a second magnetic force 138 upon the opposite surface 120 of the rigid support 118. These magnetic forces 136, 138 provide a frictional force 140 perpendicular to the magnetic forces. The frictional force 140 is parallel with the direction of movement of the sensor 116 and the rigid support 118.

Figure 2:
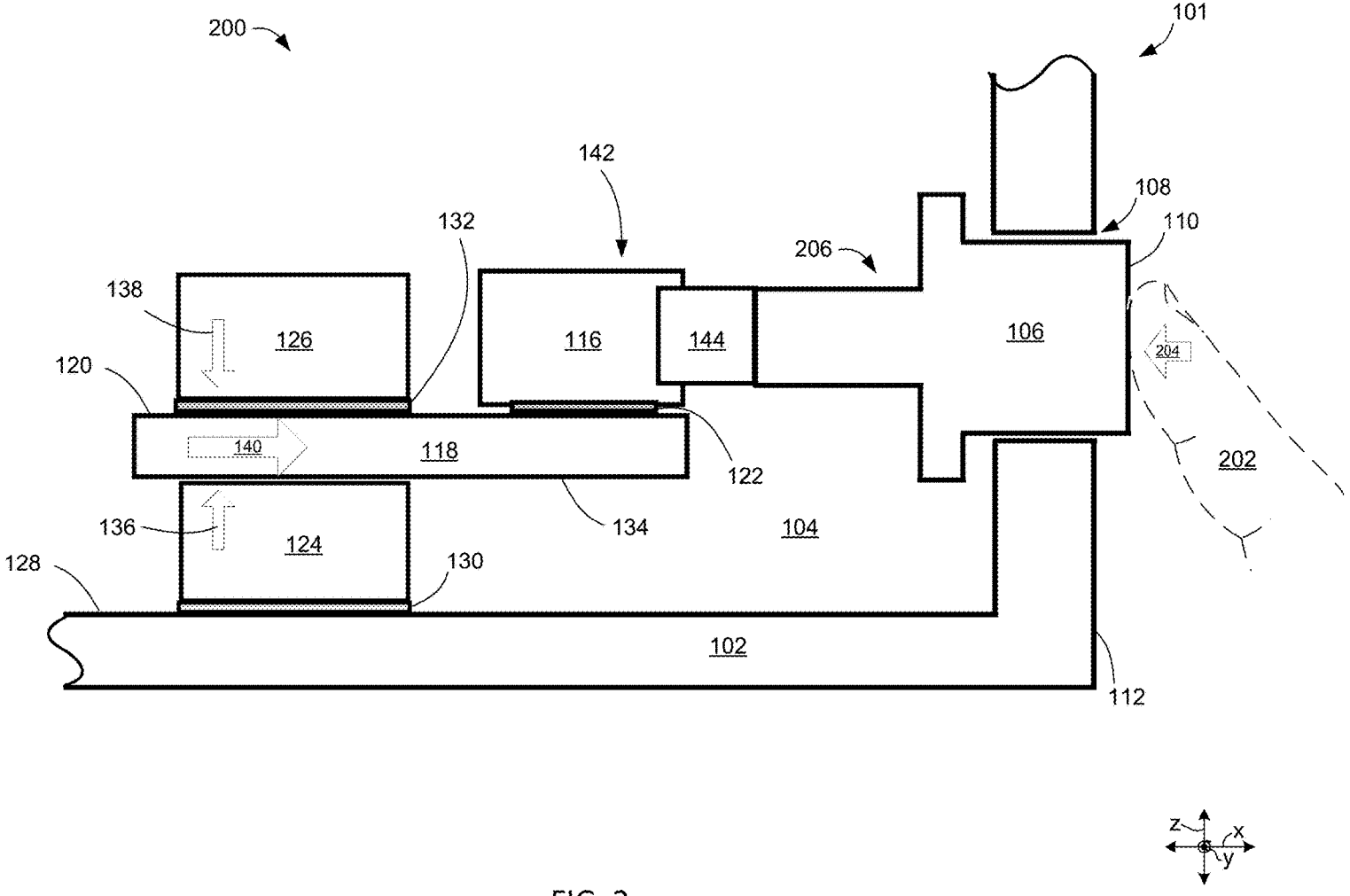
FIG. 2 depicts an example of the electronic device of FIG. 1, wherein the button is positioned in an intermediate button position and the sensor is in the first sensor position.

In other words, the frictional force 140 created by the two magnets 124, 126 may be configured to control movement of the sensor 116 and rigid support 118 between a first sensor position 142 (as depicted in FIGS. 1 and 2), and a second sensor position (discussed in further detail below in FIG. 3). This is advantageous as the sensor 116 may avoid being damaged by an impact force that exceeds the frictional force 140 retaining the sensor in place. The relationship between the various forces is further explained below with FIGS. 2 and 3.

FIG. 2 depicts a second configuration 200 of the electronic device 101, wherein the button has been pressed inward by a user's finger 202. The user's finger 202 may apply an activation force 204 on the external surface 110 of the button 106, to press the button 106 inward, i.e., toward the internal volume 104 of the electronic device 101. When the activation force 204 exceeds a designed threshold level, the button 106 moves inward toward the internal volume 104 to make contact or increase the amount of contact with the sensor 116 (e.g., mechanical switch). The inward movement of the button 106 may generate an electrical connection, or a change in the electrical connection, with a circuit connected to the sensor.

The threshold level of force may be designed such that accidental contact with the button 106 does not move the button 106, change the amount of contact with the sensor 116, or activate a function of the electronic device 101. In one example, one or more springs 144 may be positioned between an inside surface of the button 106 and the sensor 116. In such an example, a threshold amount of force is required to compress the spring 144 and allow the button 106 and sensor 116 to contact each other or increase the amount of contact with each other. Upon removal of the activation force 204, the compressed spring expands to return the button 106 to its steady state or original location (e.g., as depicted in FIG. 1).

During operation of the electronic device 101, the activation force 204 by the user's finger moves the button 106 inward to an intermediate button position 206. The sensor 116 and rigid support 118 are retained in the first sensor position 142 by the frictional force 140 provided by the first magnet 124 and the second magnet 126 as measured in a same plane or parallel plane as the activation force 204. In other words, the electronic device 101 is configured such that the activation force 204 is less than the frictional force 140. This is advantageous is providing an arrangement wherein an activation force 204 by a user's finger does not overcome the frictional force 140 holding the rigid support 118 and sensor 116 in place (which would move the rigid support 118 and sensor 116 away from the button 106 and not activate the sensor 116). In other words, the sensor 116 is configured to be activated when a user presses the button with their finger.

Figure 3:
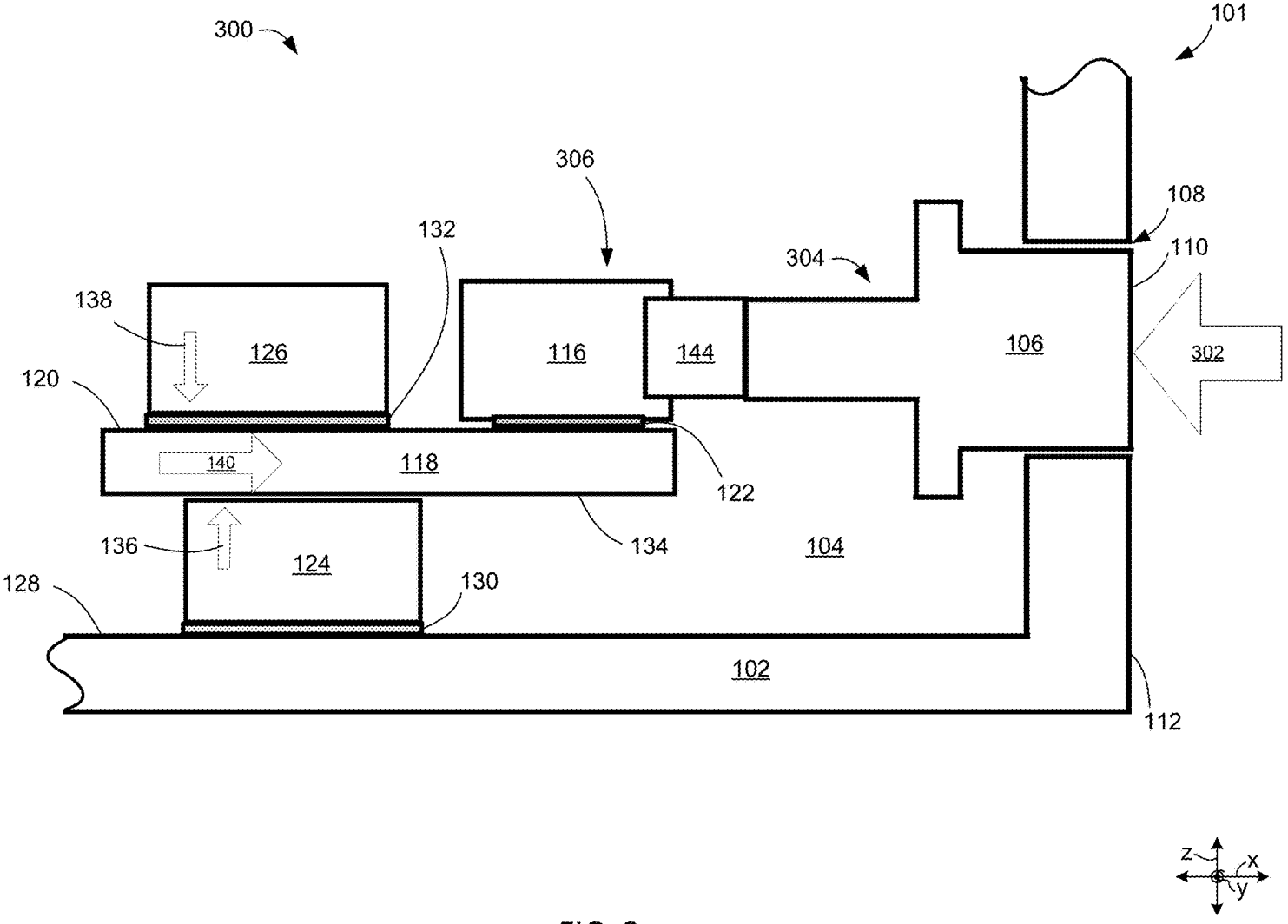
FIG. 3 depicts an example of the electronic device of FIG. 1, wherein the button is positioned in a second button position and the sensor is in a second sensor position.

FIG. 3 depicts a third configuration 300 the electronic device 101, wherein the button 106 has been moved further inward by an excessive force 302 (e.g., a drop impact force) such that the external surface 110 of the button 106 is flush with the external surface 112 of the chassis 102. The button 106 is positioned in a second button position 304 and the sensor is in a second sensor position 306.

When there is a potentially damaging situation to the electronic device 101 (e.g., the electronic device 101 is dropped on the button 106 or the user applies an excessive amount of input force 302), the sensor 116 and rigid support 118 are configured to move from the first sensor position 142 to the second sensor position 306 to avoid damage to the internal components of the electronic device 101 (e.g., the sensor 116). In other words, the frictional force 140 retaining the sensor 116 and rigid support 118 in the first sensor position 142 is at least temporarily overcome by the force greater than the friction force 140 such that the sensor 116 and rigid support 118 move with the button 106 and avoid damage to the sensor 116. This allows the sensor 116 and rigid support 118 to travel a small distance (e.g., 0.1 mm, 0.2 mm, 0.3 mm, 0.4 mm, 0.5 mm, or 1 mm) within the chassis 102 (in a direction away from the external surface 112 of the chassis 102) to avoid damage to the sensor 116 by the excessive force 602 on the button 106. After the excessive input force 302 is removed, the magnetic attraction forces 136, 138 from the two magnets 124, 126 are configured to return the sensor 116 and rigid support 118 to their original positions inside the chassis 102 (i.e., the first sensor position 142).

The electronic device 101 may be configured such that the frictional force 140 from the magnets 124, 126 is overcome by an input force 302 that is less than a drop impact force. Also, the electronic device 101 may be configured such that the frictional force 140 from the magnets is overcome by an input force 302 that is less than a sensor damage force (as measured in the same plane or parallel plane as the activation force 204).

In certain examples, the electronic device 101 is configured such that the activation force 204 is less than the frictional force 140, and the frictional force 140 is less than the sensor damage force. This configuration is advantageous in that the sensor 116 and the rigid support 118 move from the first sensor position 142 to the second sensor position 306 before the sensor 116 is damaged (e.g., when there is an input force that is less than the sensor damage force). In other words, the ability for the sensor 116 to move positions within the chassis 102 based on the amount of input force on the button 106 is advantageous as the sensor 116 is configured to be triggered under standard operating conditions and move to avoid damage under excessive input force conditions.

In certain examples, the sensor damage force is less than the drop impact force as measured in the direction from the button to the sensor and along the plane including the button and the sensor. In certain examples, the drop impact force is at least 50 Newtons (N) of force, 75 N, 100 N, 200 N, 300 N, 500 N, or 1000 N.

Figure 4:
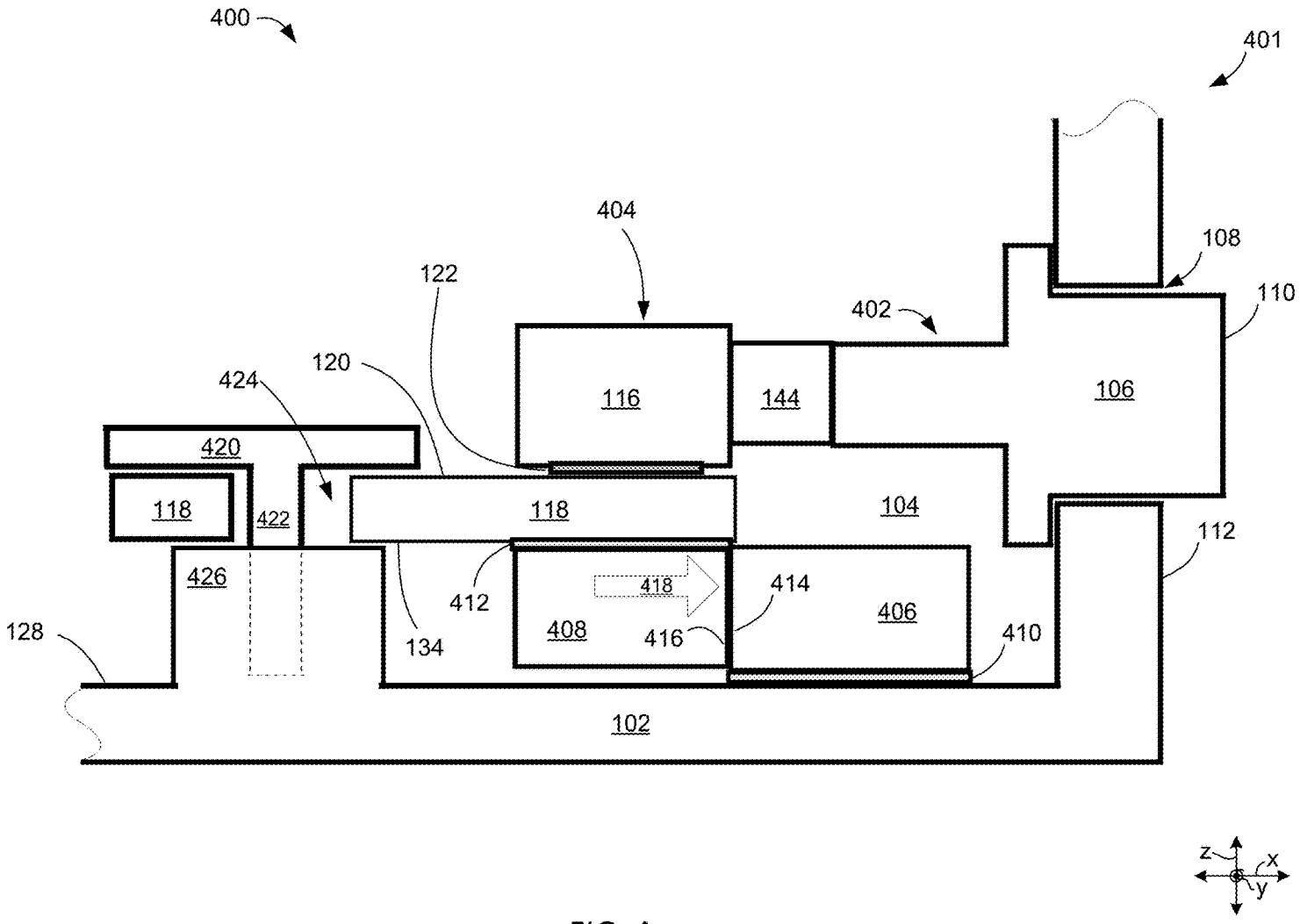
FIG. 4 depicts an additional example of an electronic device having a button in a first button position and a sensor in a first sensor position.
Figure 5:
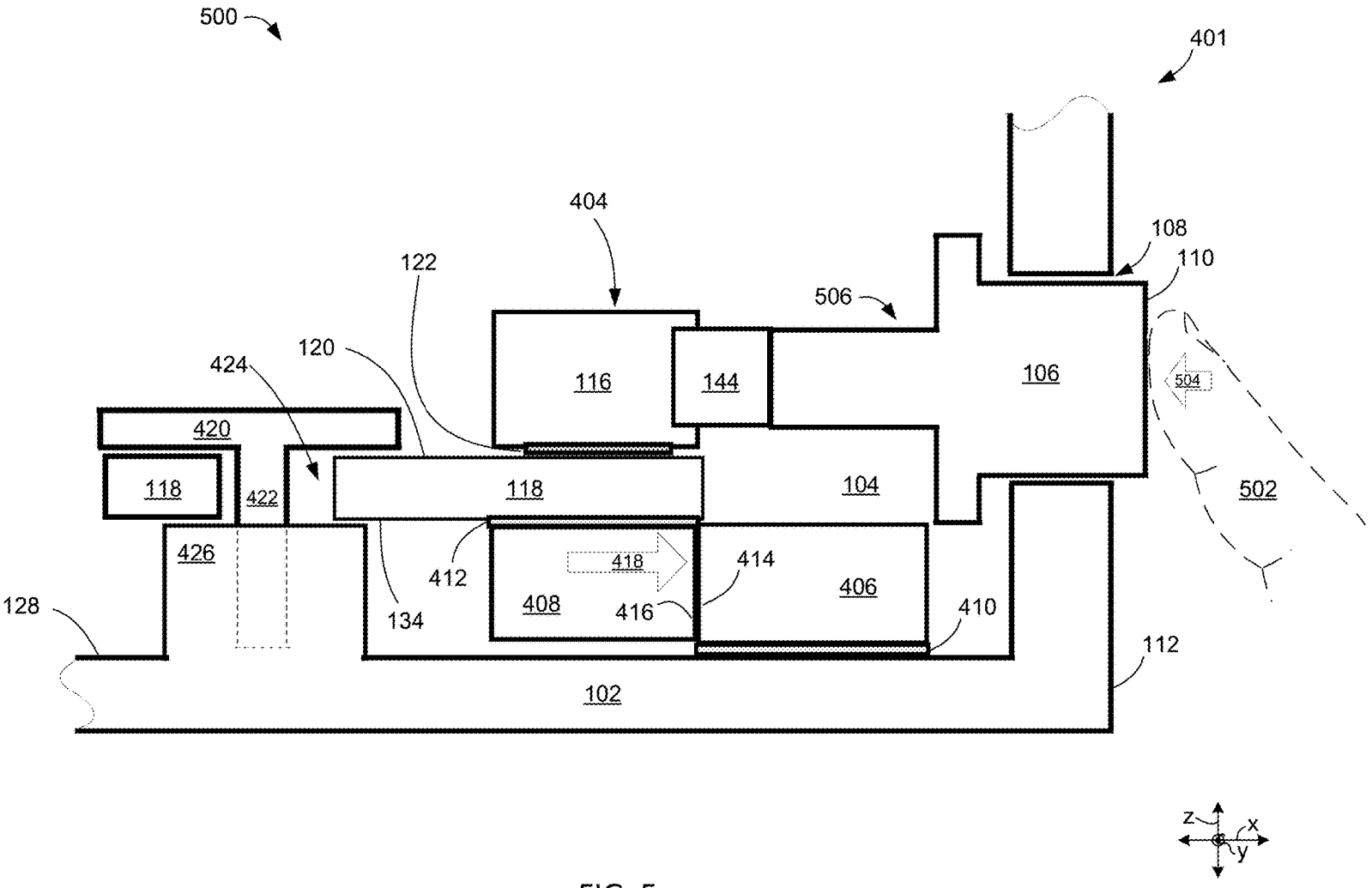
FIG. 5 depicts an example of the electronic device of FIG. 4, wherein the button is positioned in an intermediate button position and the sensor is in the first sensor position.
Figure 6:
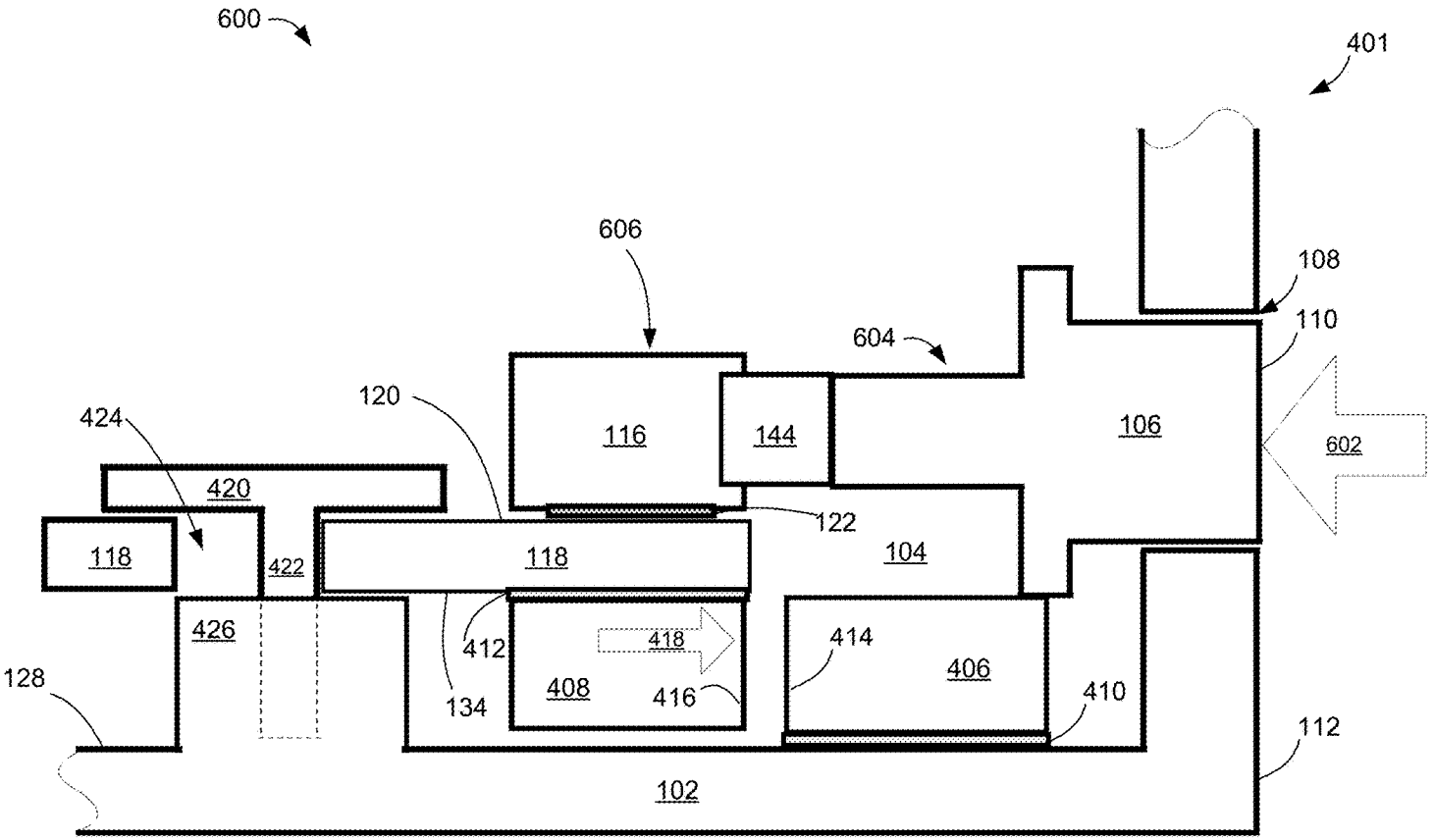
FIG. 6 depicts an example of the electronic device of FIG. 4, wherein the button is positioned in a second button position and the sensor is in a second sensor position.

As noted above, the positioning of the at least one magnet within the electronic device is configurable. FIGS. 4-6 depict a second example of an electronic device 401 in different configurations.

FIG. 4 depicts a first configuration 400 of an electronic device 401 including a housing or chassis 102 having an internal volume 104 configured to house internal components of the electronic device 401.

An external button 106 is positioned within an opening 108 of the chassis 102. The button 106 protrudes from the opening 108 of the chassis 102, wherein the external surface 110 of the button 106 is positioned farther from the internal volume 104 of the chassis than the outer surface 112 of the chassis 102 (as viewed along the x-axis). The button 106 is located in a first button position 402.

The button 106 is in communication with a sensor 116 positioned within the internal volume 104 of the electronic device 401. The button 106 is configured to be pressed by a user to activate the sensor 116. As mentioned above, the sensor 116 is a mechanical switch. In alternative examples, the sensor may be a capacitive sensor array, resistive touch sensor, a plurality of pressure sensitive sensors (e.g., membrane switches using a pressure sensitive ink), an optical sensor, a piezoelectric sensor (e.g., a piezoelectric film), another input sensing mechanism, or any combination thereof. The sensor 116 may be connected directly or indirectly to a rigid support 118.

The rigid support 118 may include a circuit (e.g., a printed circuit board). The sensor 116 (e.g., mechanical switch) is adhered to a first surface 120 of the rigid support 118 (e.g., printed circuit board). The sensor 116 may be soldered to the rigid support via a solder joint or an adhesive layer 122.

At least one magnet is positioned within the internal volume 104 of the chassis 102, wherein the at least one magnet is configured to control movement of the sensor 116 and rigid support 118 within the chassis 102 between one or more sensor positions. As depicted in FIG. 4, the sensor 116 is positioned in a first sensor position 404.

The at least one magnet includes a first magnet 406 and a second magnet 408. The first magnet 406 is affixed to an internal surface 128 of the chassis 102. The first magnet 406 may be soldered to the chassis 102 via a solder joint or an adhesive layer 410.

A second magnet 408 is affixed to a second surface 134 of the rigid support 118. The second magnet 408 may be soldered to the rigid support 118 via a solder joint or adhesive layer 412.

The first and second magnets 406, 408 may be any type of magnet such as described above. In certain examples, the first and second magnets 406, 408 are the same type of magnet made of a same composition. In other examples, the first and second magnets 406, 408 are made of different compositions. For example, one of the magnets may be a steel block, while the second magnet is a different composition (e.g., a rare earth magnet).

The first and second magnets 406, 408 may be configured as dipole magnets positioned relative to each other such that the north pole of one magnet is adjacent to the south pole of the additional magnet (wherein the magnets are attracted to each other).

As noted above, the size and shape of the first and second magnets 406, 408 may be configurable as well based on the size of the electronic device and the desired magnetic force provided by the magnets 406, 408.

The positioning of the first magnet 406 in relation to the second magnet 408 is also configurable. In one example, the first magnet 406 is positioned such that the center of the first magnet 406 is aligned with the center of the second magnet 408 along an axis parallel with the internal surface 128 of the chassis 102 (e.g., the x-axis in FIG. 4). In other examples, the center of the first magnet is not aligned with the second magnet along the x-axis when the sensor and rigid support are positioned in the first sensor position. In other examples, the positioning of the first magnet 406 relative to the second magnet 408 is based on an auto-alignment of the two magnets by the attraction forces of the two magnets.

As depicted in FIG. 4, the first magnet 406 and the second magnet 408 are positioned adjacent to each other such that a surface 414 of the first magnet 406 is coupled to a surface 416 of the second magnet 408 when the button 106 is in the first button position 402 and the sensor 116 is in the first sensor position 404. The magnets are arranged such that the first magnet 406 is attracted to the second magnet 408. The polarity at the surface 414 of the first magnet 406 may have an opposite polarity as the surface 416 of the second magnet 408 adjacent to the surface 414 of the first magnet 406. This provides a magnetic force 418 or attraction force that links or couples the two magnets together. The magnetic force 418 is parallel with the direction of movement of the sensor 116 and the rigid support 118.

This magnetic force 418 is configurable to control the movement of the sensor 116 and rigid support 118 within the chassis 102. In other words, the attraction or magnetic force 418 created by the two magnets 406, 408 may be configured to control movement of the sensor 116 and rigid support 118 between the first sensor position 404 (as depicted in FIGS. 4 and 5), and a second sensor position (discussed in further detail below in FIG. 6). As noted above, this is advantageous as the sensor 116 may avoid being damaged by an impact force that exceeds the magnetic force 418 retaining the sensor in place. The relationship between the various forces is further explained below with FIGS. 5 and 6.

As depicted in FIG. 4, the electronic device also includes at least one sliding guide 420 configured to guide the sensor 116 and rigid support 118 between the first sensor position 404 and the second sensor position (discussed below in FIG. 6). The sliding guide 420 is configured to linearly guide the sensor 116 and rigid support 118 along a plane (e.g., the x,y-plane). This is advantageous in preventing the sensor and rigid support from rotating about the x,y-plane or bending upwards or downwards within the internal volume (e.g., as viewed in the z-direction). The sliding guide 420 may include a guide post 422 extend through an opening 424 within the rigid support 118 to prevent rotational movement of the rigid support 118 and the attached sensor 116. The sliding guide 420 may be connected (e.g., via the guide post 422) to the internal surface 128 of the chassis 102. Alternatively, a second sliding guide 426 may be provided on an opposite side of the rigid support 118. The second sliding guide 426 may be configured from part of the internal surface 128 of the chassis 102, or the second sliding guide may be affixed to the internal surface 128 of the chassis 102 or an intermediate surface in between.

As depicted in FIG. 4, the first sliding guide 420 is adjacent to or abuts a first surface 120 of the rigid support 118. The second sliding guide 426 is adjacent to or abuts the second, opposite surface 134 of the rigid support. The guide post 422 is positioned in between the first and second sliding guides 420, 426. As such, the rigid support 118 is configured to guide along a linear path in the x-y-plane.

FIG. 5 depicts a second configuration 500 of the electronic device 401, wherein the button has been pressed inward by a user's finger 502. The user's finger 502 may apply an activation force 504 on the external surface 110 of the button 106, to press the button 106 inward, i.e., toward the internal volume 104 of the electronic device 401. When the activation force 504 exceeds a designed threshold level, the button 106 moves inward toward the internal volume 104 to make contact or increase the amount of contact with the sensor 116 (e.g., mechanical switch). The inward movement of the button 106 may generate an electrical connection, or a change in the electrical connection, with a circuit connected to the sensor.

The threshold level of force may be designed such that accidental contact with the button 106 does not move the button 106, change the amount of contact with the sensor 116, or activate a function of the electronic device 401. In one example, one or more springs 144 may be positioned between an inside surface of the button 106 and the sensor 116. In such an example, a threshold amount of force is required to compress the spring 144 and allow the button 106 and sensor 116 to contact each other or increase the amount of contact with each other. Upon removal of the activation force 504, the compressed spring expands to return the button 106 to its steady state or original location (e.g., as depicted in FIG. 4).

During operation of the electronic device 401, the activation force 504 by the user's finger moves the button 106 inward to an intermediate button position 506. The sensor 116 and rigid support 118 are retained in the first sensor position 404 by the magnetic force 418 provided by the first magnet 406 and the second magnet 408 as measured in a same plane or parallel plane as the activation force 504. In other words, the electronic device 401 is configured such that the activation force 504 is less than the magnetic force 418. As noted above, this is advantageous is providing an arrangement wherein an activation force 504 by a user's finger does not overcome the magnetic force 418 holding the rigid support 118 and sensor 116 in place (which would move the rigid support 118 and sensor 116 away from the button 106 and not activate the sensor 116). In other words, the sensor 116 is configured to be activated when a user presses the button with their finger.

FIG. 6 depicts a third configuration 600 the electronic device 401, wherein the button 106 has been moved further inward by an excessive force 602 (e.g., a drop impact force) such that the external surface 110 of the button 106 is flush with the external surface 112 of the chassis 102. The button 106 is positioned in a second button position 604 and the sensor is in a second sensor position 606.

When there is a potentially damaging situation to the electronic device 401 (e.g., the electronic device 401 is dropped on the button 106 or the user applies an excessive amount of input force 602), the sensor 116 and rigid support 118 are configured to move from the first sensor position 404 to the second sensor position 606 to avoid damage to the internal components of the electronic device 401 (e.g., the sensor 116). In other words, the magnetic force 418 retaining the sensor 116 and rigid support 118 in the first sensor position 404 is at least temporarily overcome by the force greater than the magnetic force 418 such that the sensor 116 and rigid support 118 move with the button 106 and avoid damage to the sensor 116. This allows the sensor 116 and rigid support 118 to travel a small distance (e.g., 0.1 mm, 0.2 mm, 0.3 mm, 0.4 mm, 0.5 mm, or 1 mm) within the chassis 102 (in a direction away from the external surface 112 of the chassis 102) to avoid damage to the sensor 116 by the excessive force 602 on the button 106. After the excessive input force 602 is removed, the magnetic or attraction force 418 from the two magnets 406, 408 is configured to return the sensor 116 and rigid support 118 to their original positions inside the chassis 102 (i.e., the first sensor position 404).

The electronic device 401 may be configured such that the magnetic force 418 from the magnets 124, 126 is overcome by an input force 602 that is less than a drop impact force. Also, the electronic device 401 may be configured such that the magnetic force 418 from the magnets is overcome by an input force 602 that is less than a sensor damage force (as measured in the same plane or parallel plane as the activation force 504).

In certain examples, the electronic device 401 is configured such that the activation force 504 is less than the magnetic force 418, and the magnetic force 418 is less than the sensor damage force. This configuration is advantageous in that the sensor 116 and the rigid support 118 move from the first sensor position 404 to the second sensor position 606 before the sensor 116 is damaged (e.g., when there is an input force that is less than the sensor damage force). In other words, the ability for the sensor 116 to move positions within the chassis 102 based on the amount of input force on the button 106 is advantageous as the sensor 116 is configured to be triggered under standard operating conditions and move to avoid damage under excessive input force conditions.

In certain examples, the sensor damage force is less than the drop impact force as measured in the direction from the button to the sensor and along the plane including the button and the sensor. In certain examples, the drop impact force is at least 50 Newtons (N) of force, 75 N, 100 N, 200 N, 300 N, 500 N, or 1000 N.

As noted above, in addition to electronic devices having an external button, a similar arrangement may be applied to an electronic device having an I/O interface. In such an embodiment, the I/O interface and any connected internal components (e.g., a sensor or circuit) may be protected from an excessive force applied to the I/O interface. For example, if a user inserts a device (e.g., a USB stick or headphone jack) into the I/O interface with an excessive force, the I/O interface may move inward like described above in FIGS. 1-6 to avoid damage to the I/O interface, a sensor, and/or a circuit connected with the I/O interface.

Figure 7:
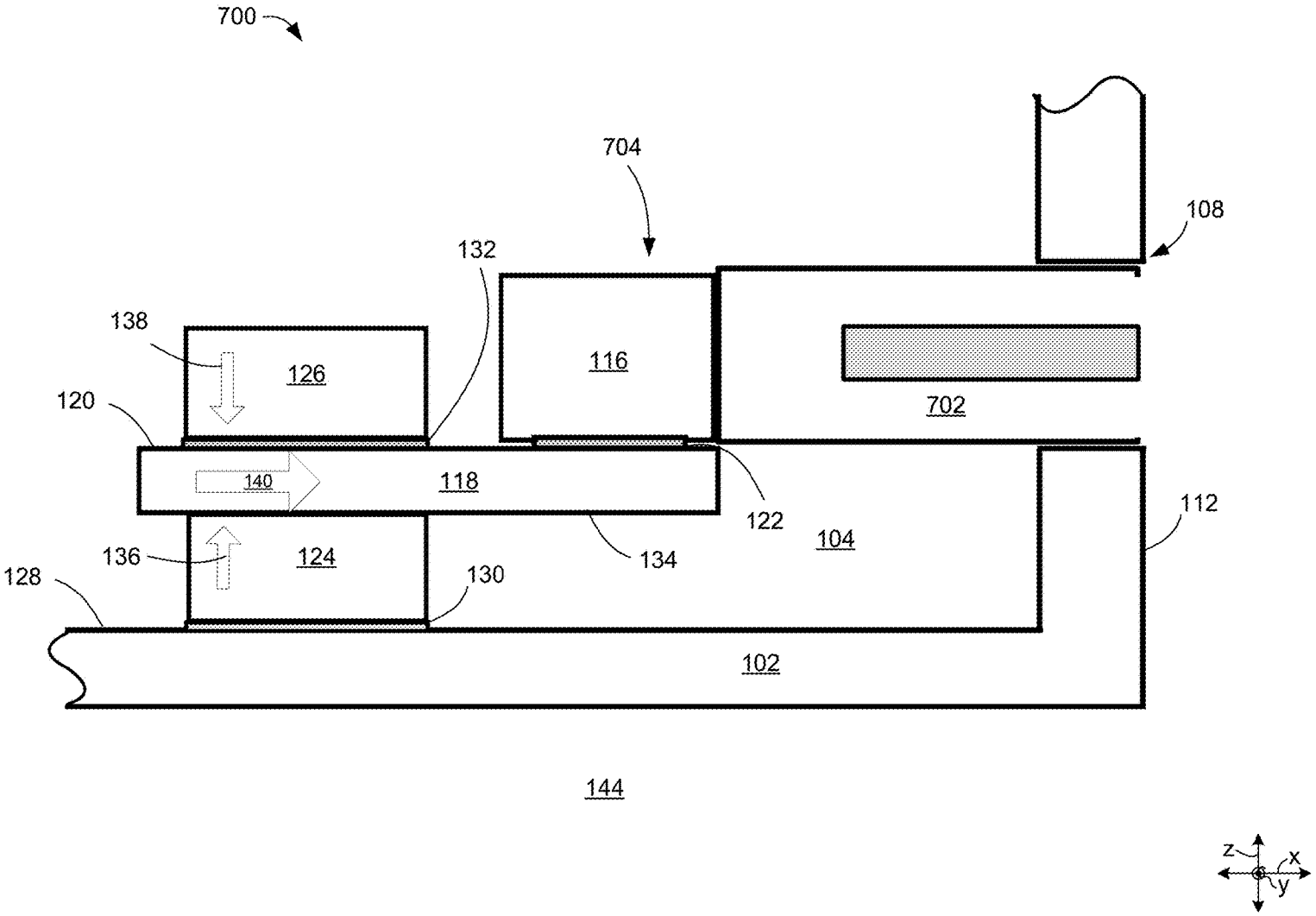
FIG. 7 depicts an example of an electronic device having an input/output interface and connected sensor.

FIG. 7 depicts an electronic device 700 having an I/O interface 702 (e.g., a USB port). The electronic device may be configured similarly to the devices and configurations discussed above for FIGS. 1-6. In other words, the electronic device 700 may include a housing or chassis 102 having an internal volume 104 configured to house internal components of the electronic device 700.

The I/O interface 702 is positioned within an opening 108 of the chassis 102. The I/O interface 702 may be positioned at any location along a surface of the chassis 102.

The I/O interface 702 may be a universal serial bus (USB) port, an IEEE 1394 port, a small computer system interface (SCSI) interface, a PS/2 port, an audio connection (e.g., an audio jack), a musical instrument digital interface (MIDI), an Ethernet or phone jack, a coaxial port, a serial communications port, a parallel port, and so on.

The I/O interface 702 may include an internal sensor or be in communication with an external sensor 116 positioned within the internal volume 104 of the electronic device 700. When an external device is inserted into the I/O interface 702, the I/O interface may be configured to move inward to avoid damage to the I/O interface 702 or connected sensor 116 (such as described above with reference to FIGS. 1-6).

As noted above, the sensor 116 may be connected directly or indirectly to a rigid support 118. The rigid support 118 may include a circuit (e.g., a printed circuit board).

At least one magnet is positioned within the internal volume 104 of the chassis 102, wherein the at least one magnet is configured to control movement of the sensor 116 and rigid support 118 within the chassis 102 between one or more positions. As depicted in FIG. 7, the input/output interface 702 and the sensor 116 are positioned in a first position 704.

The at least one magnet includes a first magnet 124 and a second magnet 126. The first magnet 124 is affixed to an internal surface 128 of the chassis 102. A second magnet 126 is affixed to a surface 120 of the rigid support 118.

As described above, the frictional force 140 created by the two magnets 124, 126 may be configured to control movement of the input/output interface 702, the sensor 116, and rigid support 118 between a first position 704, and a second position (such as described in FIGS. 3 and 6). This is advantageous as the I/O interface and sensor 116 may avoid being damaged by an impact force that exceeds the frictional force 140 retaining the sensor in place.

Figure 8:
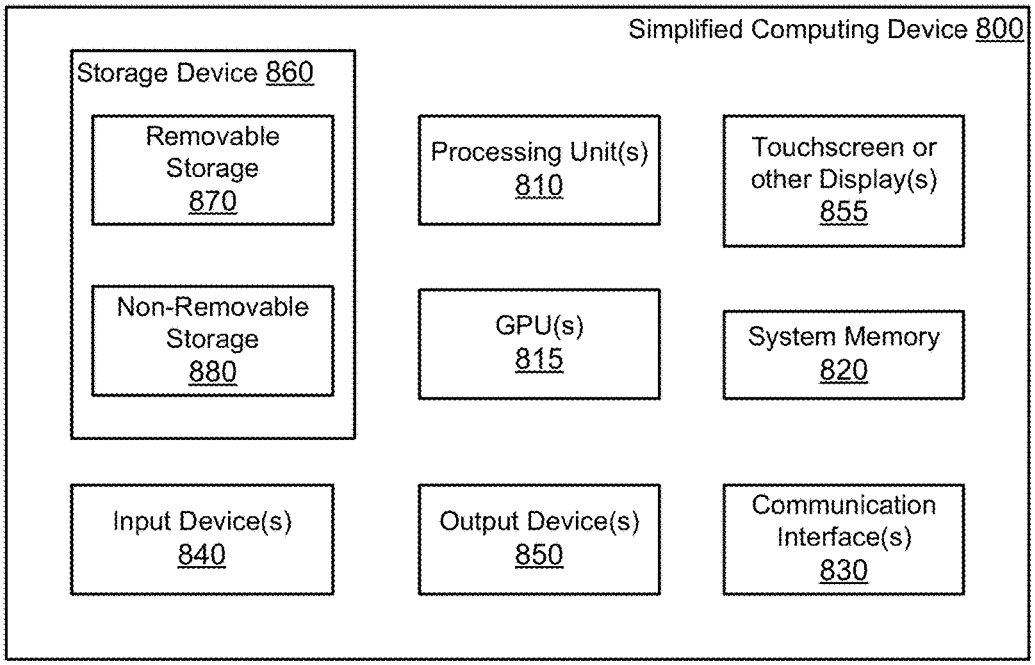
FIG. 8 is a block diagram of a computing environment in accordance with one example for implementation of the button and sensor components or aspects thereof.

With reference to FIG. 8, the electronic devices and components described above may be incorporated within a computing environment 800. The computing environment 800 may correspond with one of a wide variety of computing devices, including, but not limited to, personal computers (PCs), server computers, tablet and other handheld computing devices, laptop or mobile computers, communication devices such as mobile phones, multiprocessor systems, microprocessor-based systems, set top boxes, programmable consumer electronics, network PCs, minicomputers, mainframe computers, audio or video media players, or video game controllers. In certain examples, the computing environment 800 is a wearable electronic device, wherein the device may be worn on or attached to a person's body or clothing. The wearable electronic device may be attached to a person's shirt or jacket; worn on a person's wrist, ankle, waist, or head; or worn over their eyes or ears. Such wearable devices may include a watch, heart-rate monitor, activity tracker, or head-mounted display.

The computing environment 800 has sufficient computational capability and system memory to enable basic computational operations. In this example, the computing environment 800 includes one or more processing unit(s) 810, which may be individually or collectively referred to herein as a processor. The computing environment 800 may also include one or more graphics processing units (GPUs) 815. The processor 810 and/or the GPU 815 may include integrated memory and/or be in communication with system memory 820. The processor 810 and/or the GPU 815 may be a specialized microprocessor, such as a digital signal processor (DSP), a very long instruction word (VLIW) processor, or other microcontroller, or may be a general purpose central processing unit (CPU) having one or more processing cores. The processor 810, the GPU 815, the system memory 820, and/or any other components of the computing environment 800 may be packaged or otherwise integrated as a system on a chip (SoC), application-specific integrated circuit (ASIC), or other integrated circuit or system.

The computing environment 800 may also include one or more sensors 825 (e.g., an accelerometer, gyroscope, or inclinometer) configured to determine the orientation of various sections of the electronic device. As noted above, the sensors may be configured to identify an orientation or position of a first section of the electronic device relative to the orientation of a second section of the device.

The computing environment 800 may also include other components, such as, for example, a communications interface 830. One or more computer input devices 840 (e.g., pointing devices, keyboards, audio input devices, video input devices, haptic input devices, or devices for receiving wired or wireless data transmissions) may be provided. The input devices 840 may include one or more touch-sensitive surfaces, e.g., track pads. Various output devices 850, including touchscreen or touch-sensitive display(s) 855, may also be provided. The output devices 850 may include a variety of different audio output devices, video output devices, and/or devices for transmitting wired or wireless data transmissions.

The computing environment 800 may also include a variety of computer readable media for storage of information such as computer-readable or computer-executable instructions, data structures, program modules, or other data. Computer readable media may be any available media accessible via storage devices 860 and includes both volatile and nonvolatile media, whether in removable storage 870 and/or non-removable storage 880. Computer readable media may include computer storage media and communication media. Computer storage media may include both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which may be used to store the desired information and which may be accessed by the processing units of the computing environment 800.

While the present claim scope has been described with reference to specific examples, which are intended to be illustrative only and not to be limiting of the claim scope, it will be apparent to those of ordinary skill in the art that changes, additions and/or deletions may be made to the disclosed embodiments without departing from the spirit and scope of the claims.

The foregoing description is given for clearness of understanding only, and no unnecessary limitations should be understood therefrom, as modifications within the scope of the claims may be apparent to those having ordinary skill in the art.

Claim Support Section

In a first embodiment, an electronic device comprises a chassis having an internal volume configured to house internal components of the electronic device; a button positioned within an opening of the chassis, wherein the button is configured to move from a first button position to a second button position, wherein, in the first button position, a surface of the button extends beyond an external surface of the chassis, and wherein, in the second position, the surface of the button is located at a closer distance to the external surface of the chassis than in the first button position; a rigid support positioned within the internal volume of the chassis; a sensor connected with the rigid support and in communication with the button, wherein the button is configured to contact the sensor at an intermediate button position located between the first button position and the second button position; and at least one magnet positioned within the internal volume of the chassis, wherein the at least one magnet is configured to retain the sensor in a first sensor position when the button moves between the first button position and the intermediate button position, and wherein the at least one magnet is configured to release the sensor from the first sensor position such that the sensor moves from the first sensor position to a second sensor position before the button moves from the intermediate button position to the second button position.

In a second embodiment, an electronic device comprises a housing; a button extending through an opening of the housing; a sensor in communication with the button, wherein the button is configured to contact the sensor in a first sensor position upon application of an activation force as measured in a direction from the button to the sensor and along a plane including the button and the sensor; and at least one magnet configured to retain the sensor in the first sensor position by a frictional or magnetic force as measured in a same plane or parallel plane as the activation force, wherein the sensor is configured to move from the first sensor position to a second sensor position upon application of a force greater than the frictional or magnetic force and less than a sensor damage force, as measured in the same plane or parallel plane as the activation force, and wherein the activation force is less than the frictional or magnetic force, and the frictional or magnetic force is less than the sensor damage force.

In a third embodiment, an electronic device comprises a housing; an input/output interface positioned within an opening of the housing; a sensor in communication with the input/output interface; and at least one magnet configured to retain the input/output interface and the sensor in the first position by a frictional or magnetic force, wherein the input/output interface and the sensor are configured to move away from the opening of the housing from the first position to a second position upon application of a force to the input/output interface that is greater than the frictional or magnetic force and less than a sensor damage force.

In a fourth embodiment, with reference to any of embodiments 1-3, the sensor is a mechanical switch.

In a fifth embodiment, with reference to any of embodiments 1-4, the rigid support is a printed circuit board.

In a sixth embodiment, with reference to any of embodiments 1-5, the electronic device further comprises a flexible circuit, wherein the sensor is connected to the flexible circuit that is connected to the rigid support.

In a seventh embodiment, with reference to any of embodiments 1-6, the at least one magnet comprises a first magnet and a second magnet, wherein the first magnet is affixed to an internal surface of the chassis and the second magnet is affixed to a surface of the rigid support such that the rigid support is positioned between the first magnet and the second magnet.

In an eighth embodiment, with reference to any of embodiments 1-6, the at least one magnet comprises a first magnet and a second magnet, wherein the first magnet is affixed to an internal surface of the chassis and the second magnet is attached to a surface of the rigid support, wherein a surface of the first magnet is coupled to a surface of the second magnet when the sensor is in the first sensor position, and wherein the surface of the first magnet is detached from the surface of the second magnet when the sensor is in the second sensor position.

In a ninth embodiment, with reference to any of embodiments 1-8, the electronic device further comprises a sliding guide configured to guide the sensor in a plane between the first sensor position and the second sensor position, wherein the button moves in a plane between the first button position and the second button position, and wherein the plane of the sensor movement and the plane of the button movement are a same plane or parallel planes.

In a tenth embodiment, with reference to the ninth embodiment, a surface of the sliding guide abuts a surface of the rigid support such that the sliding guide is configured to guide the rigid support and the sensor connected with the rigid support.

In an eleventh embodiment, with reference to any of embodiments 1-10, wherein the sensor damage force is less than an application of a drop impact force as measured in the direction from the button to the sensor and along the plane including the button and the sensor, wherein the drop impact force is at least 50 Newtons.

In a twelfth embodiment, with reference to any of embodiments 1-11, wherein the electronic device comprises a rigid support, wherein the sensor is connected with the rigid support.

What is claimed is:

1. An electronic device comprising:

a chassis having an internal volume configured to house internal components of the electronic device;

a button positioned within an opening of the chassis, wherein the button is configured to move from a first button position to a second button position, wherein, in the first button position, a surface of the button extends beyond an external surface of the chassis, and wherein, in the second button position, the surface of the button is located at a closer distance to the external surface of the chassis than in the first button position;

a rigid support positioned within the internal volume of the chassis;

a sensor connected with the rigid support and in communication with the button, wherein the button is configured to contact the sensor at an intermediate button position located between the first button position and the second button position;

a first magnet affixed to an internal surface of the chassis; and a second magnet attached to a surface of the rigid support, wherein the first and second magnets are configured to retain the sensor in a first sensor position when the button moves between the first button position and the intermediate button position, and wherein the first and second magnets are configured to release the sensor from the first sensor position such that the sensor moves from the first sensor position to a second sensor position before the button moves from the intermediate button position to the second button position, wherein a surface of the first magnet is coupled to a surface of the second magnet when the sensor is in the first sensor position, and wherein the surface of the first magnet is detached from the surface of the second magnet when the sensor is in the second sensor position.

2. The electronic device of claim 1, wherein the sensor is a mechanical switch.

3. The electronic device of claim 1, wherein the rigid support is a printed circuit board.

4. The electronic device of claim 1, further comprising:

a flexible circuit, wherein the sensor is connected to the flexible circuit that is connected to the rigid support.

5. The electronic device of claim 1, further comprising:

a sliding guide configured to guide the sensor in a plane between the first sensor position and the second sensor position, wherein the button moves in a plane between the first button position and the second button position, and wherein the plane of the sensor movement and the plane of the button movement are a same plane or parallel planes.

6. An electronic device comprising:

a housing;

a button extending through an opening of the housing;

a sensor in communication with the button, wherein the button is configured to contact the sensor in a first sensor position upon application of an activation force as measured in a direction from the button to the sensor and along a plane including the button and the sensor;

a rigid support connected with the sensor;

a first magnet affixed to an internal surface of the housing; and a second magnet affixed to a surface of the rigid support such that the rigid support is positioned between the first magnet and the second magnet, wherein the first and second magnets are configured to retain the sensor in the first sensor position by a frictional force as measured in a same plane or parallel plane as the activation force, wherein the frictional force is provided by a force of the first magnet on the rigid support and a force of the second magnet on the rigid support, wherein the sensor is configured to move from the first sensor position to a second sensor position upon application of a force greater than the frictional force and less than a sensor damage force, as measured in the same plane or parallel plane as the activation force, and wherein the activation force is less than the frictional force, and the frictional force is less than the sensor damage force.

7. The electronic device of claim 6, wherein the sensor damage force is less than an application of a drop impact force as measured in the direction from the button to the sensor and along the plane including the button and the sensor, wherein the drop impact force is at least 50 Newtons.

8. The electronic device of claim 6, wherein the rigid support is a printed circuit board.

9. The electronic device of claim 6, further comprising:

a sliding guide configured to guide the sensor in the plane between the first sensor position and the second sensor position.

10. The electronic device of claim 9, wherein a surface of the sliding guide abuts a surface of the rigid support such that the sliding guide is configured to guide the rigid support and the sensor connected with the rigid support.

11. The electronic device of claim 10, wherein the rigid support is a printed circuit board.

12. The electronic device of claim 6, wherein the sensor is a mechanical switch.

13. An electronic device comprising:

a housing;

a button extending through an opening of the housing;

a sensor in communication with the button, wherein the button is configured to contact the sensor in a first sensor position upon application of an activation force as measured in a direction from the button to the sensor and along a plane including the button and the sensor;

a rigid support connected with the sensor;

a first magnet attached to an internal surface of the housing; and a second magnet attached to a surface of the rigid support, wherein a surface of the first magnet is coupled to a surface of the second magnet when the sensor is in the first sensor position, wherein the first and second magnets are configured to retain the sensor in the first sensor position by a magnetic force as measured in a same plane or parallel plane as the activation force, wherein the sensor is configured to move from the first sensor position to a second sensor position upon application of a force greater than the magnetic force and less than a sensor damage force, as measured in the same plane or parallel plane as the activation force, wherein the surface of the first magnet is detached from the surface of the second magnet when the sensor is in the second sensor position, and wherein the activation force is less than the magnetic force, and the magnetic force is less than the sensor damage force.

14. The electronic device of claim 13, wherein the rigid support is a printed circuit board.

15. The electronic device of claim 13, further comprising:

a sliding guide configured to guide the sensor in the plane between the first sensor position and the second sensor position.

16. The electronic device of claim 15, wherein a surface of the sliding guide abuts a surface of the rigid support such that the sliding guide is configured to guide the rigid support and the sensor connected with the rigid support.

17. The electronic device of claim 16, wherein the rigid support is a printed circuit board.

18. The electronic device of claim 13, wherein the sensor is a mechanical switch.

* * * * *